United States Patent [19]

Saji et al.

[11] Patent Number: 5,030,325

[45] Date of Patent: Jul. 9, 1991

[54] METHOD OF MANUFACTURING GLOSS PAPER

[75] Inventors: Soichi Saji; Tatsuya Nakabai; Teruo Nakamura, all of Hyogo, Japan

[73] Assignee: Kanzaki Paper Mfg. Co., Ltd., Tokyo, Japan

[21] Appl. No.: 369,631

[22] Filed: Jun. 21, 1989

[30] Foreign Application Priority Data

Jun. 29, 1988 [JP] Japan ..... 63-163081

[51] Int. Cl.[5] ..... D21H 19/38

[52] U.S. Cl. ..... 162/135; 162/164.1; 162/168.1; 162/169; 162/181.1; 162/181.3; 162/181.5

[58] Field of Search ..... 162/181.1, 164.1, 169, 162/168.1, 135, 181.3, 181.5; 428/342; 106/461, 471, 494; 427/391, 397.7

[56] References Cited

U.S. PATENT DOCUMENTS 4,064,304 12/1977 Fujita et al. ..... 428/342

OTHER PUBLICATIONS

Casey, *Pulp and Paper,* 3rd ed. vol. IV (1983) John Wiley & Sons, p. 2076.

*Primary Examiner*—Peter Chin

*Attorney, Agent, or Firm*—Flynn, Thiel, Boutell & Tanis

[57] ABSTRACT

A method of manufacturing gloss coated paper by applying a coating composition containing a pigment and an adhesive on base paper. The pigment contains 5 to 40% by weight of satin white with an average particle diameter of 0.8 μm or below and an organic pigment with an average particle diameter of 0.1 to 1.0 μm and a glass transition point (Tg) of 40° C. or above. The weight ratio of the satin white to the organic pigment is from 0.2/1 to 5/1. The coating composition provides a coated paper with excellent gloss and smoothness.

4 Claims, No Drawings

METHOD OF MANUFACTURING GLOSS PAPER

FIELD OF THE INVENTION

This invention relates to the manufacture of gloss paper and, more particularly, to a method of manufacturing gloss paper having excellent smoothness, gloss and visual gloss by using as a pigment a composition containing satin white and an organic pigment.

DESCRIPTION OF THE PRIOR ART

Recently, there has been an increasing demand for improving the gloss, visual gloss and smoothness of the coated surface of coated paper, particularly for printing, to meet a trend for visualization of print, color printing and high quality printing. In fact, various processes of manufacturing coated paper for printing have been proposed. For example, a multi-layer coating process using a blade coater has been proposed for coating, and a finishing process using a calender at a high temperature of 100° C. or above (disclosed in Japanese Patent Disclosure 54-125712 and Japanese Patent Publication 49-21252) has been proposed for finishing. As for the coating composition, there are many proposals of the use of fine particle pigments such as satin white, super-fine particle kaolin, super-fine particle calcium carbonate, etc. and the coating process using a high concentration coating color at a high concentration of 65 wt. % or above. However, if it is desired to obtain coated paper having a higher quality, there are many problems which have to be solved.

The present invention offers to provide high quality coated paper, which has excellent smoothness, gloss and visual gloss.

Generally, a coating composition contains 70 wt. % or above of a pigment. Particularly, it is well known that the kind and size and shape of the pigment particles greatly influence the gloss and smoothness of the coating layer.

Usually, a plurality of different pigments are used in combination to provide features of the individual pigments. However, it is possible to obtain only effects based on the features of the individual pigments, and there is hardly a case of obtaining a synergistic effect of a combination of different pigments.

The inventors noted and conducted a study on satin white and organic pigments which are well known as pigments for improving the gloss, smoothness and ink receptivity of a coated paper.

More specifically, satin white is used as a highly white pigment in combination with kaolin and other pigments for the purpose of improving the gloss, smoothness, ink receptivity, etc. of coated paper. It is a white pigment consisting of needle-like crystals of calcium sulfoaluminate which chemical formula is generally accepted as $3CaO.Al_2O_3.3CaSO_4.31\ 32H_2O$, and generally it is prepared by reacting an aqueous suspension of slaked lime or quick lime with aluminum sulfate or alum. However, the size and shape of its particles are greatly influenced by the reaction temperature and time, concentration at the time of reaction and agitation time. In other words, the size and shape of the product satin white vary with conditions at the time of the reaction.

Organic pigments are generally called plastic pigments and have excellent properties with respect to gloss and brightness and they provide varying effects depending on the particle size, glass transition point (Tg), etc.

In light of the above, extensive researches and investigations have been made on white pigments. As a result, it was found that when a coating composition incorporating satin white having a certain paricle size and a particular organic pigment in particular proportions is used, it is possible to obtain a synergistic effect based on the quality characteristics of the two components, so that the smoothness, gloss and visual gloss of coated paper can be greatly improved to obtain coated paper having an excellent gloss. The invention is based on this finding.

SUMMARY OF THE INVENTION

According to the invention, there is provided a method of manufacturing gloss coated paper by coating a coating composition mainly composed of a pigment and an adhesive on a base paper, then drying said coated composition and finishing the coated paper. The pigment contains 5 to 40% by weight of satin white with an average particle diameter of 0.8 μm or below and an equal amount of an organic pigment with an average particle diameter of 0.1 to 1.0 μm and a glass transition point (Tg) of 40° C. or above to the total pigment, the weight ratio of satin white and organic pigment being set to 0.2 to 5.

DESCRIPTION OF THE PREFERRED EMBODIMENTS

According to the invention, the satin white that is used has an average particle diameter of 0.8 μm or below. The average particle diameter is measured by the following method.

5 wt % of sodium polyacrylate is added as a dispersing agent to satin white (solid) to prepare a satin white dispersion with a concentration of 2 to 3 wt. %. Then, the dispersion was agitated at 30° to 35° C. for 5 minutes by using an ultrasonic disperser. Then the particle size distribution was measured by a gravity precipitation process (by using "Sedigraph 5000-01", a trade name by Shimadzu Corp., and with the specific gravity of satin white set to 1.77). The equivalent diameter for 50% of the obtained particle size distribution is used as the average particle diameter of satin white. Satin white has a needle-like or bar-like crystal shape. To obtain synergistic effects of satin white and organic pigment according to the invention, it is best to use this average particle diameter measurement method for investigation.

Organic pigments, which are another important kind of pigment used in accordance with the invention, should have an average particle diameter in a range of 0.1 to 1.0 μm and a glass transition point (Tg) of 40° C. or above. It was found that when and only when the above quality conditions of satin white and organic pigment are satisfied, a pronounced synergistic effect of the two components can be obtained to obtain the desired coated paper, which has excellent gloss and smoothness and is extremely well suited for printing.

The constitution and properties of the pigment as features of the invention will now be described in detail.

The proportions of satin white and organic pigment as specified according to the invention are each 5 to 40 wt. %, preferably 8 to 30 wt. %, of the overall pigment. The solids ratio of satin white to organic pigment is 0.2/1 to 5/1, preferably 0.3/1 to 4/1. Satin white contains a large amount of crystal water. Therefore, its dry weight is determined according to the invention as the absolute weight measured after leaving it at 105° C. for 24 hours.

The specified proportions of satin white and organic pigment as noted above are particularly important conditions for obtaining very excellent coated paper quality as a purpose of the invention. If the solid ratio of satin white to organic pigment is outside the range of 0.2/1 to 5/1, the intended synergistic effect of the two different pigments can not be obtained. In this case, the intended outstanding quality of coated paper can not be obtained.

Further, if the average particle diameter of satin white used according to the invention exceeds 0.8 μm, the desired effect of improvement according to the invention can not be obtained even if the solid ratio noted above is met. If the average particle diameter of satin white is less than 0.1 μm, on the other hand, not only the effect of improvement can not be obtained, but also the adhesion is reduced. Therefore, the average particle diameter of satin white is desirably no less than 0.1 μm. The average particle diameter of the organic pigment used according to the invention is in a range of 0.1 to 1.0 μm, preferably 0.15 to 0.7 μm. Unless this range is met, not only is the desired effect according to the invention not met, but also the adhesion, brightness and opacity of the coated paper are reduced.

The reason why it is possible according to the invention to obtain quality improvement of coated paper, excellent smoothness, gloss and visual gloss, by using the specified satin white and organic pigment in the specified solid ratio, is not perfectly clear. However, it is presumed that when a coating color mainly composed of the specified pigment composition according to the invention is coated, needle-like or bar-like crystals of satin white are arranged parallel to one another while spherical particles of organic pigment, which have a lower specific gravity, are suitably arranged between adjacent satin white crystals, so that the spherical organic pigment particles are effectively deformed at the time of finishment by application of heat and pressure, thus producing very excellent smoothness, gloss and visual gloss on the coating layer surface.

According to the invention, any organic pigment can be used without any particular limitation on the method of its manufacture, form, composition, etc. For example, it is possible to use the solid organic pigments disclosed in Japanese Patent Publication 46-6524, Japanese Patent Disclosure 55-16938 and Japanese Patent Publication 62-29558, hollow organic pigments disclosed in Japanese Patent Publications 56-161742, 61-7003, 61-87734 and 61-201096 and further those disclosed in Japanese Patent Disclosures 54-151606, 57-66196 and 60-45696, which have a double-layer structure consisting of a core of a polymer incapable of forming a film and a surface layer of a polymer capable of film formation and have the character of a binder pigment, i.e., slightly have the function of a binder while having the character of an organic pigment. Polystyrene is generally used as the organic pigment but it is also possible to replace part of the styrene with a different monomer as disclosed in Japanese Patent Disclosure 60-199997. It is possible to use other monomers than styrene such as α-methyl styrene, 4-methylstyrene, divinylbenzene and other aromatic vinyl compounds. Methylemthacrylate, ethylacrylate, butylacrylate and other α- and β-ethylene type unsaturated carbonic acid ester, vinyl chloride, vinylidene chloride and other halogenated olefins, acrylonitrile and other unsaturated nitriles and butadiene and other conjugate diolefins may also be used. Further, if necessary, it is possible to copolymerize monomers having functional groups such as acrylic acid, methacrylic acid, itaconic acid and other α- and β-ethylene type unsaturated carbonic acid, hydroxyethylacrylate, hydroxyethylmethacrylate and other unsaturated carbonic acid hydroxyalkylesters, acrylic amide, methacryloric amide and other unsaturated amides.

As has been shown, according to the invention, one or more pigments for coated paper such as clay kaolin, aluminum hydroxide, calcium carbonate, titanium dioxide, barium sulfate, zinc oxide, calcium sulfate and talc are used suitably a pigment in addition to satin white and organic pigments.

The adhesive may be one or more adhesives for coated paper such as casein, soybean protein, synthetic protein and other proteins, styrene-buthadiene copolymer and other conjugate diene polymer latexes, acrylic acid ester and/or methacrylic acid ester polymers or copolymers thereof and other acrylic polymer latexes, ethylenevinyl acetate copolymer and vinyl polymer latexes or alkali-soluble or -insoluble polymer latexes obtained by denaturing these polymer latexes with monomers containing carboxyl group or other functional groups, polyvinyl alcohol, olefin-maleic anhydride resins, melamine resins and other synthetic resin adhesives; anionic starch, oxidized starch and other starches and carboxymethyl cellulose, hydroxyethyl cellulose and other cellulose derivatives.

The amount of the adhesive is generally adjusted to a range of 5 to 50 wt. parts, preferably 10 to 30 wt. parts, based on 100 wt. parts of the pigment. If necessary, the coating composition may contain various additives such as de-foaming agent, coloring agents, lubricating agents, thickening agents, etc. As an auxiliary agent for promoting the solidification of the coating layer may be added an amine, amide polyacrylamine and a salt of a multi-valent metal such as zinc, aluminum, magnesium, calcium and barium in an amount of 0.1 to 10 wt. parts based on 100 wt. parts of the pigment.

The coating composition obtained in the above conditions is coated in one or more layers on base paper with an on- or off-machine coater provided with such coating means as a blade coater, an air knife coater, a roll coater, a reverse roll coater, a bar coater, a curtain coater, a die slot coater, a gravure coater, a champflex coater, size press coater, etc., used in the manufacture of general coated paper.

The solids concentration of the coating composition at this time is generally 40 to 75 wt. %, but from consideration of operability or the like, it is suitably 45 to 70 wt. %.

As a base paper is used paper- or board-base paper of 30 to 400 g/m$^2$ used as general coated paper for printing is satisfactory. The method of paper-making is by no means limited, and it may be either acidic or alkaline paper-making. Of course, it is possible to use wood-contained base paper containing high yield pulp. Further, it is possible to use base paper with a preliminary coating provided by a size press or bill blade.

The amount of coating on base paper is generally 3 to 50 g/m$^2$ in dry weight per single surface.

From the standpoint of consideration of the white paper quality and adaptability to printing of the obtained coated paper, it is suitably adjusted to 8 to 25 g/m$^2$.

The method of drying the wet coating layer is by no means limited, and it is possible to use various systems such as steam heating, hot air heating, heating by a gas heater, heating by an electric heater, heating by an infrared ray heater, high frequency heating, laser heating and electron beam heating. If the organic pigment forms a film and loses its function in the drying process, the visual gloss and ink receptivity of the coated paper deteriorate extremely, so that the intended effect according to the invention can not be obtained. Therefore, it is necessary to adjust the drying conditions so as to avoid film formation.

According to the invention, the coated paper obtained in the manner as described above is treated with a heat calender to obtain coated paper having an excellent quality.

For example various calenders comprising metal rolls and elastic rolls such as super-calenders and gloss calenders (as disclosed in Japanese Patent Disclosure 49-132305 and Japanese Announced Patent Publication 63-500188), and soft-compact calenders (as disclosed in "Pulp & Paper Technology Times (Japanese edition)", August 1987, p-p. 31–36, PPI, No. 11, 1987, p-p. 45–47 and WFP, 1985, 22, p-p. 873–877) are suitably as the on- or off-machine.

The metal roll surface may be mirror-surface treated by means of hard chromium plating. As the elastic roll, rolls of polyurethane, polyamide, etc. and rolls produced by molding cotton, asbestos, nylon, aramid fiber, etc. are suitably used. Setting the surface temperature of the metal roll to 100° C. or above is preferred, for the plasticization of the coating layer is promoted. In this case, highly heat-resistant materials such as rolls made of aramid fibers are suitably used.

Various process conditions for calendering are suitably controlled depending on the type of the intended coated paper, base paper conditions, character and dry weight of the coating layer, moisture content in paper and the operating speed of the calender. As for the surface temperature of the calender roll, if the organic pigment in the coating layer forms a film in the calendering process, it will result in the extreme deterioration of the quality of the coated paper for printability such as ink receptivity and wet adhesion as noted before in connection with the drying method. In this case, the effect of improvement according to the invention can not be obtained. Therefore, it is necessary to control the temperature condition depending on the kind of the organic pigment, so that the pigment does not form a perfect film.

The nip pressure of the calender roll in actual operation is suitably held at 100 to 500 kg/cm of linear pressure. Generally, it is controlled in a range of 150 to 350 kg/cm. The number of pressure application nips is usually 2 to 6 per drum in case of a soft compact calender and 3 to 11 in case of a super-calender. The moisture content the coated paper before entering the nips is suitably 3 to 10%. The operation speed of the calender varies greatly depending on the weight, kind and quality of paper, but it is generally 100 to 1,300 m/min.

It is, of course, possible to provide equipment with a roll for water coating, an electrostatic humidifier, a steam humidifier, etc. for control and addition of moisture to the coated paper after finishing or to use various techniques known in the field of coated paper manufacture in suitable combinations.

Now, examples are given to describe the invention in greater detail. Parts or % in the following description of the examples are by weight unless otherwise specified.

EXAMPLE 1

60 parts of kaolin (trade name "UW-90" by EMC Inc.) and 20 parts of fine natural ground calcium carbonate (trade name "Carbital 90" by Fuji Kaoline Co., Ltd. Japan, in solid form) were used together with satin white of an average particle diameter of 0.3 μm and an organic pigment with of an average particle diameter of 0.5 μm and a glass transition point (Tg) of 100° C. such that the weight ratio of satin white to organic pigment was 1/1, specifically 10 parts of satin white and 10 parts of organic pigment. To this coating composition was added 0.2 part of sodium polyacrylate, and the resultant admixture was agitated using a Cowles dissolver to obtain a slurry with a solids concentration of 66%.

To this pigment slurry were added 2 parts of oxidized starch (in solid form) and 12 parts of styrene-buthadiene copolymer latex (trade name "JSR 0696" by Japan Synthetic Rubber Co., Ltd., in solid form) and then water, thus preparing a coating color with a solids concentration of 60%.

This coating color was coated on both sides a base paper of 70 g/m$^2$ using a blade coater such that its dry weight was 20 g/m$^2$ on each side and was then dried using a drier at a surface temperature of 120° C. to obtain double-sided coated paper with a moisture content of 6.5%. The obtained coated paper was subjected to super-calendering under conditions of a temperature of 60° C., 9 nips and a linear pressure of 200 kg/cm to obtain double-sided gloss coated paper.

EXAMPLE 2

Double-sided gloss coated paper was obtained in the same manner as in Example 1 except that the ratio of satin white to organic pigment was set to $\frac{2}{3}$, i.e., 8 parts of satin white and 12 parts of organic pigment were used.

EXAMPLE 3

Double-sided gloss coated paper was obtained in the same manner as in Example 1 except that the ratio of satin white to organic pigment was set to 3/1, i.e., 15 parts of satin white and 5 parts of organic pigment were used. The result of quality evaluation of the obtained gloss coated paper is shown in Table 1.

EXAMPLE 4

Double-sided gloss coated paper was obtained in the same manner as in Example 1 except for that styrene-butadiene copolymer with an average particle diameter of 0.25 μm and a Tg of 55° C. was used as the organic pigment.

EXAMPLE 5

Double-sided gloss coated paper was obtained in the same manner as in Example 1 except that styrene-acryle with an average particle diameter of 0.5 μm and a Tg of 105° C. was used. As a finishing process, the paper was subjected to a soft compact calender under conditions of a temperature of 150° C., 4 nips and a linear pressure of 250 kg/cm.

EXAMPLE 6

Double-sided gloss coated paper was obtained in the same manner as in Example 1 except for that satin white with an average diameter of 0.5 μm was used. The same finishing process as in Example 5 was performed.

EXAMPLE 7

40 parts of kaolin (trade name "UW-90" by EMC Inc.) and 10 parts of precipitated calcium carbonate (trade name "Brilliant S-15" by Shiraishi Kogyo Co., Ltd., in solid form) were used together with satin white of an average particle diameter of 0.5 μm and organic pigment consisting of styrene polymer of an average particle diameter of 0.5 μm and a Tg a 100° C. such that the weight ratio of satin white to organic pigment was 1/1, specifically, 25 parts of satin white and 25 parts of organic pigment. To this composition was added 0.2 part of sodium polyacrylate, and the resultant admixture was agitated using a Cowles dissolver to prepare a slurry with a solid concentration of 47%.

To this pigment were added 2 parts of oxidized starch (in solid form) and 14 parts of styrene-butadiene copolymer latex (trade name "JSR 0696" by Japan Synthetic Rubber Co., Ltd. in solid form) and then water to prepare a coating color with a solids concentration of 45%.

This coating color was coated on both sides of a base paper of 70 g/m$^2$ using an air knife coater such that the dry coating weight was 20 g/m$^2$ on each side and then dried using a drier at 140° C. to obtain double-sided coated paper with a moisture content of 6.5%. The obtained coated paper was subjected to super-calendering under conditions of a temperature of 60° C., 9 nips and a linear pressure of 200 kg/cm to obtain double-sided gloss coated paper.

CONTRAST EXAMPLE 1

Double-sided gloss coated paper was obtained in the same manner as in Example 1 except that no satin white and 20 parts of organic pigment were used.

CONTRAST EXAMPLE 2

Double-sided gloss coated paper was obtained in the same manner as in Example 1 except no organic pigment and 20 parts of satin white were used.

CONTRAST EXAMPLE 3

Double-sided gloss coated paper was obtained in the same manner as in Example 1 except that the ratio of satin white to organic pigment was set to 1/9, specifically, 2 parts of satin white and 18 parts of organic pigments were used.

CONTRAST EXAMPLE 4

Double-sided gloss coated paper was obtained in the same manner as in Example 1 except that the ratio of satin white to organic pigment was set to 9/1, specifically 18 parts of satin white and 2 parts of organic pigment were used.

CONTRAST EXAMPLE 5

Double-sided gloss coated paper was obtained in the same manner as in Example 1 except that satin white with an average particle diameter of 1.0 μm was used.

CONTRAST EXAMPLES 6 AND 7

Double-sided gloss coated paper was obtained in the same manner as in Example 1 except that organic pigments with average particle diameters of 1.5 μm (Contrast Example 6) and 0.05 μm (Contrast Example 7) were used.

CONTRAST EXAMPLE 8

Double-sided gloss coated paper was obtained in the same manner as in Example 1 except that styrene-butadiene copolymer with an average particle diameter of 0.25 μm and Tg of 20° C. was used as the organic pigment.

The double-sided gloss coated paper obtained by the method according to the invention had excellent quality, including printability.

Particularly, the coated paper obtained after a high temperature calender treatment had a pronounced effect in the improvement of gloss.

What is claimed is:

1. A method of manufacturing gloss coated paper comprising the steps of:

coating a composition comprising a pigment and an adhesive on a base paper; drying said coated base paper; and finishing said dried, coated paper, said pigment comprising 5 to 40% by weight of satin white particles and particles of an organic pigment, said satin white particles having an average particle diameter of 0.1 to 0.8 microns and said organic pigment particles having an average particle diameter of 0.1 to 1.0 microns and a glass transition point (Tg) of 40° C. or higher, said satin white being contained in said pigment in a weight ratio of 0.2/1 to 5/1 with respect to said organic pigment.

2. A method of manufacturing gloss coated paper according to claim 1, wherein said finishing comprises supplying said dried, coated paper through a nip consisting of a metal roll heated to at least 100° C. and an elastic roll.

3. A method of manufacturing gloss coated paper according to claim 1, wherein the average particle diameter of the satin white is 0.3 microns and the average particle size of the organic pigment is 0.5 microns.

4. A method of manufacturing gloss coated paper according to claim 1, wherein the average particle diameter of the satin white is 0.5 microns and the average particle size of the organic pigment is 0.25 microns.

* * * * *